US006173061B1

(12) United States Patent
Norris et al.

(10) Patent No.: US 6,173,061 B1
(45) Date of Patent: Jan. 9, 2001

(54) STEERING OF MONAURAL SOURCES OF SOUND USING HEAD RELATED TRANSFER FUNCTIONS

(75) Inventors: John Norris, Santa Monica; Timo Kissel, Woodland Hills, both of CA (US)

(73) Assignee: Harman International Industries, Inc., Northridge, CA (US)

( * ) Notice: Under 35 U.S.C. 154(b), the term of this patent shall be extended for 0 days.

(21) Appl. No.: 08/880,329

(22) Filed: Jun. 23, 1997

(51) Int. Cl.[7] ..... H04R 5/00
(52) U.S. Cl. ..... 381/309; 381/1
(58) Field of Search ..... 381/17, 300–309, 381/307, 74, 310, 311

(56) References Cited

U.S. PATENT DOCUMENTS

| | | | |
|---|---|---|---|
| 4,893,342 | 1/1990 | Cooper et al. . | |
| 4,910,779 | 3/1990 | Cooper et al. . | |
| 4,975,954 | 12/1990 | Cooper et al. . | |
| 5,034,983 | 7/1991 | Cooper et al. . | |
| 5,136,651 | 8/1992 | Cooper et al. . | |
| 5,333,200 | 7/1994 | Cooper et al. . | |
| 5,525,862 * | 6/1996 | Miyazaki . | |
| 5,684,881 * | 11/1997 | Serikawa et al. | 381/17 |
| 5,715,317 * | 2/1998 | Nakazawa | 381/309 |
| 5,799,094 * | 8/1998 | Mouri | 381/17 |

FOREIGN PATENT DOCUMENTS 0 762 373 * 3/1997 (EP) .

OTHER PUBLICATIONS

Japaneese Abstract, 04265933, Published Date 9/22/92.*

* cited by examiner

*Primary Examiner*—Vivian Chang
(74) *Attorney, Agent, or Firm*—Haynes & Boone, L.L.P.

(57) ABSTRACT

A system is disclosed for steering a monaural audio signal representing a source of sound into left and right audio signals for presentation to the corresponding ears of a listener so that the listener perceives the sound source in a specific location relative to his head. The left and right signals may be provided through headphones or loudspeakers, in the latter case employing techniques to cancel the crosstalk from each loudspeaker into the opposite ear of the listener. The monaural audio signal is filtered using head-related transfer functions (HRTFs) into the left and right outputs, these being equivalent to the acoustic HRTFs that would be generated if a source of sound were placed at the specific location relative to the listener.

5 Claims, 6 Drawing Sheets

STEERING OF MONAURAL SOURCES OF SOUND USING HEAD RELATED TRANSFER FUNCTIONS

TECHNICAL FIELD

This invention relates to the steering of monaural sources of sound to any desired location in space surrounding a listener by using the head-related transfer function (HRTF) and compensating for the crosstalk associated with reproduction on a pair of loudspeakers.

More particularly, the invention provides an efficient system whereby any number of monaural sound sources can be steered in real time to any desired spatial locations. The system incorporates compensation of the loudspeaker feed signals to cancel crosstalk, and a new technique for interpolation between measured HRTFs for known sound source locations in order to generate appropriate HRTFs for sound sources in intermediate locations.

REFERENCES TO RELATED ART

The following are references to related patents and papers in the art:

1. Atal B. S. and Schroeder, M. R., "Apparent Sound Source Translator," U.S. Pat. 3,236,949, Feb. 22, 1966.
2. Blauert. J., "Lateralization in the Median Plane," Acustica vol. 22 pp. 957–962, 1969.
3. Blauert. Jens, "Spatial Hearing," J. S. Allen, transl., MIT Press, Cambridge, Mass., 1983, 1996.
4. Cooper, D. H., and Bauck, J. L., "Head Diffraction Compensated Stereo System," U.S. Pat. No. 4,893,342, Jan. 9, 1990.
5. Cooper, D. H., and Bauck, J. L., "Head Diffraction Compensated Stereo System with Optimal Equalization," U.S. Pat. No. 4,910,799, Mar. 20, 1990.
6. Cooper, D. H., and Bauck, J. L., "Head Diffraction Compensated Stereo System with Optimal Equalization," U.S. Pat. No. 4,975,954, Dec. 4, 1990.
7. Cooper, D. H., and Bauck, J. L., "Head Diffraction Compensated Stereo System," U.S. Pat. No. 5,034,983, Jul. 23, 1991.
8. Cooper, D. H., and Bauck, J. L., "Head Diffraction Compensated Stereo System," U.S. Pat. No. 5,136,651, Aug. 4, 1992.
9. Cooper, D. H., and Bauck, J. L., "Head Diffraction Compensated Stereo System with Loud Speaker Array," U.S. Pat. No. 5,333,200, Jul. 26, 1994.
10. Cooper, D. H., and Bauck, J. L., "Prospects for Transaural Recording," J. Audio Eng. Soc., Vol. 37, pp. 3–19, 1989 January/February.
11. N. Fuchigami et al., "Method for Controlling Localization of Sound Images," U.S. Pat. No. 5,404,406, 1994.
12. Shaw, E. A. G, and Teranishi, R., "Sound Pressure Generated in an External Ear Replica and Real Human Ears by Nearby Point Sources," J. Acoust. Soc. Am., vol. 44, pp. 240–9, 1968.
13. Wright. D., Hebrank, J. H., and Wilson, B., "Pinna Reflections as Cues for Localization," J. Acoust. Soc. Am., Vol. 56, pp. 957–962, 1974.
14. Blumlein, A. D., "Improvements in and Relating to Sound Transmission," British Patent No. 394,325, filed Dec. 14, 1931, issued Jun. 14, 1933.
15. Butler, R. A., and Belendiuk, K., "Spectral Cues Utilized in the Localization of Sound in the Median Sagittal Plane," J. Acoust. Soc. Am., Vol. 61, no. 5, pp. 1264–1269, 1977.
16. Widrow, B., and Strearns, S., "Adaptive Signal Processing," Prentice-Hall, 1985.

17. Eriksson, L., "Development of the Filtered-U Algorithm for Active Noise Control," J. Acoust. Soc. Am., Vol. 89, pp. 257–265, 1990.
18. Eriksson, L., "Active Attenuation System with On Line Modeling of Speaker, Error Path and Feedback" U.S. Pat. No. 4,677,767, Jun. 30, 1987.

BACKGROUND OF THE INVENTION

Stereophonic sound reproduction systems employ psychoacoustic effects to provide a listener with the impression of a multiplicity of separate real sound sources, for example musical instruments and voices, positioned at several distinct locations across the space between the left and right loudspeakers which are usually placed symmetrically to either side in front of the listener.

Pairwise mixing is an example of an early technique for producing such an impression. The sound is provided to both channels in phase, with an amplitude ratio following a sine-cosine curve as a sound source is panned from one side of the listener to the other. While this approach has been a generally accepted one, it has proved deficient in several ways; the apparent location of the sound is not stable when the listener's head moves, and sounds between the loudspeakers appear to be above the line joining them. More recent research in psychoacoustics has shown that when sound is diffracted round the listener's head, in general the left and right ears hear different transfer functions applied to the sound; an impulse will reach the far ear later than the near ear, and the shadowing provided by the head will alter the amplitude of the sound reaching the far ear relative to that reaching the near ear, the amplitude differences being a complicated function of frequency. These functions are termed "head-related transfer functions" and include effects due to reflections of sound by the pinnae and torso of the individual listener.

A somewhat simplified model of the head as a sphere, with orifices at left and right representing the ears and without the equivalent of pinnae, can be used to derive a generic HRTF theoretically or through numerical analysis. Because there are no pinnae, there is no difference between the HRTFs for sounds to the front of or equally to the rear of the lateral center line. Also, the lack of pinnae and torso modifications precludes differences due to the height of the sound source above the plane containing the ears. Nevertheless, the "spherical head" model has at least pointed the way to understanding the subtleties of HRTF effects.

An alternative reproduction method to stereophony is binaural recording, which typically employs a "dummy head" or manikin of a generic character, with pinnae and torso effects included, which has HRTFs that may be considered "average." Microphones are placed in the ear canals of the dummy head to record the sound, which is then reproduced in the listener's ears using headphones. Because individuals differ in head size, placement and size of the ears, etc., each listener would obtain the most realistic binaural reproduction if the dummy head used for recording were an exact replica of his own head. The differences are sufficient that some listeners may have difficulty in differentiating the front or rear locations of some sounds reproduced this way. A further disadvantage of this method is that when reproduced over loudspeakers, sounds intended for reproduction only in the left or right ear are heard differentially by both ears, and the HRTFs corresponding to the loudspeaker locations are superimposed onto the sounds, contributing to unnatural frequency response effects.

Various methods for cancellation of the crosstalk between the loudspeakers have been devised, and this art is assumed in this patent application. Thus, the reproduction of binaurally recorded sound could take place either on headphones or through loudspeakers with the crosstalk cancellation method applied in the latter case.

In order to produce realistic recording and reproduction of sounds in specific locations relative to the listener, it is desirable to have a method which can simulate any location of a monaural source within the sound stage reproduced through a pair of loudspeakers. Since pairwise mixing has been found to have considerable drawbacks, a method that employs the known psychoacoustical effects of HRTFs is significantly better. Furthermore, such methods can also simulate sound locations to the sides and rear of the listener.

Although digital filtering can be used to provide these complex enhancements of the sound signals prior to mixing down onto two-channel media, for reproduction on a pair of loudspeakers, the cost and complexity of such filtering is often an obstacle to obtaining the most realistic reproduction. Therefore, the efficiency of the method must also be considered, as a method using fewer coefficients to obtain the same result will typically be lower in cost.

SUMMARY OF THE INVENTION

The present invention, therefore, provides an efficient system and method whereby any number of monaural sound sources can be steered to any desired location in space, either in real time or in another specified manner such as mixing down from multi-track recordings. The listener will be given the impression that there exist 'real' sources of sounds at these locations. The method is based on the head related transfer function (HRTF) and compensates for the crosstalk associated with the speakers.

In one embodiment, electronic signal steering apparatus converts a monaural signal derived from a sound source into left and right signals which drive corresponding headphones on a listener's head, so that the listener experiences the impression that the sound source is at a specific location relative to his head, this effect being achieved by filtering the monaural signal using transfer functions equivalent to the HRTFs that would result from placing the actual sound source at the specified location relative to the listener.

Other embodiments to be described include compensation for loudspeaker crosstalk in the filters, so that the sound may be reproduced on loudspeakers and the listener may still perceive the sound as coming from the specified location.

An advantage of the invention is that it employs measured HRTFs obtained with a standard dummy head and incorporates a technique for interpolation between measured HRTFs to obtain an HRTF corresponding to a location where there is no measured HRTF available.

A further advantage of the invention is the use of Sigma and Delta filters to give positional cues for monaural sound sources.

Another advantage of the invention is the buffer schema used to minimize the transient effects of switching between positional filters when a sound source is in apparent motion.

Another advantage claimed for the invention is that only two filters are required whether loudspeakers or headphones are used, by incorporating into these filters the crosstalk cancellation required for loudspeaker reproduction in addition to the HRTF Sigma and Delta filtering to be described.

Another advantage of the invention is that by preserving the spectral peaks and notches produced by the pinnae and torso of the dummy head, more natural reproduction is obtained than for methods employing equalization according to Cooper and Bauck.

The invention provides a further advantage in its ability to calculate the approximated concatenated HRTF filters in real time using an adaptive filtering process.

The invention may also be advantageous in providing a method and system for generating more realistic spatial sound effects from music originated in a synthesizer or computer which otherwise no satisfactory spatial rendering exists.

BRIEF DESCRIPTION OF THE DRAWINGS

The novel features believed characteristic of the present invention are set forth in the appended claims. The invention itself, as well as other features and advantages thereof, will best be understood by reference to the following detailed description of an illustrative embodiment when read in conjunction with the accompanying drawing figures, wherein:

DETAILED DESCRIPTION

Figure 1:
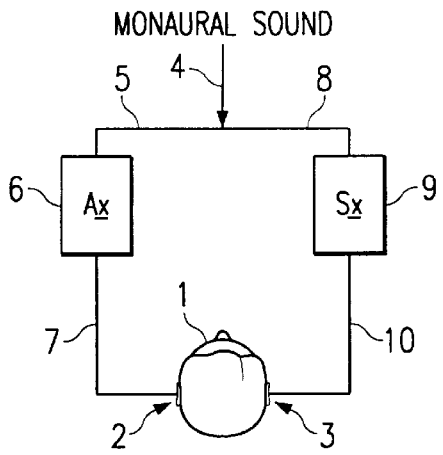
FIG. 1 shows a listener wearing headphones, with filters $A_x$ and $S_x$ to simulate a sound emanating from the direction x.

To understand the basic principle of the invention, FIG. 1 schematically illustrates a system wherein a listener 1 is wearing headphones 2 and 3 on his left and right ears respectively. A signal 4 representing a monaural source of sound at a location x is transmitted through the path 5 to a filter 6, and thence through the path 7 to the left headphone 2. The same signal is transmitted through the path 8 to a second filter 9 and thence through the path 10 to the right headphone 3.

In order that the listener 1 may have the impression that the monaural sound source is located at x, the left headphone filter 6 has the transfer function $A_x$ and the right headphone filter 9 has the transfer function $S_x$.

These two filters 6 and 9 are sufficient to reproduce any monaural sound source in any location relative to the listener. It is understood that a number of such monaural sources may each be filtered using the appropriate pair of filters, the outputs of which may be combined into a common signal for each of the left and right headphones 2 and 3. Thus, depending upon the complexity required for each of these filters, the system of the invention can provide, with only two filters per monaural source, the capability to position any number of monaural sound sources at any locations around the listener.

If the filtering is done in real time, for example from a multi-track recording, evidently a pair of filters is required for each track being mixed down to the final two channels. On the other hand, a recording produced by a serial method, laying down each new monaural signal in turn, need only use the same two filters, with variable coefficients, to record any number of voices or instruments, each in its own defined location.

Figure 2:
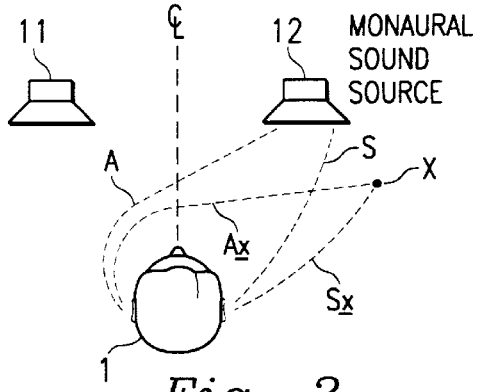
FIG. 2 shows a listener situated centrally between two loudspeakers, illustrating the different sound paths to the ears from a non-central source X and corresponding transfer functions.

FIG. 2 illustrates a typical listening situation, in which a listener 1 is on the center line between two loudspeakers 11 and 12 equally distant from the center line to the left and right respectively. A monaural source at location X is transmitted through the air by one path to the left ear, diffracting around the head, and by a different path to the right ear. The HRTFs for these two different paths are notated as $A_x$ and $S_x$ respectively.

It will be seen that for the right loudspeaker, which is a monaural source of sound, there is a path A to the left ear, and a separate path S to the right ear. A similar situation obtains for the left loudspeaker. Since the head and the listening arrangement have lateral symmetry, it follows that A and S for the left loudspeaker 11 are identical to S and A respectively for the right speaker 12. In practice, human heads are rarely exactly symmetrical, but this approximation is true of a typical dummy head.

For loudspeaker listening, therefore, it is necessary to remove the crosstalk components so that each ear hears only the correct signal.

The HRTF filter function is usually obtained by using a dummy head, which is a stylized model human head, of roughly average size and shape. Microphones aide placed either at the ends or the entrances of the ear canals, for reproduction by in-the-ear or over-the-ear headphones respectively. If the HRTF is to be reproduced by loudspeakers or over-the-ear headphones, but was recorded with in-the-ear microphones, then the transfer function of the ear canals must be removed before reproducing the signals through the transducers.

Passing the signal from the monaural sound source through the pair of HRTF filters 6, 9 of FIG. 1 with appropriate additional filtering to remove such unwanted effects as ear canal response and crosstalk from the loudspeakers will give the listener the impression that the sound source is located at the precise location where the mixing engineer has placed it.

For the listener of FIG. 2, the crosstalk between the two loudspeakers must be removed. Atal and Schroeder [1] showed how to remove the cross talk by inverse filtering of the signals using the HRTFs associated with the loudspeakers. Consider the listener of FIG. 2 with sound signals being fed to the left and right loudspeakers. The sounds heard by the listener in each ear can be expressed as:

$$T_{Spk} = \begin{pmatrix} S(\omega) & A(\omega) \\ A(\omega) & S(\omega) \end{pmatrix} \quad and$$

$$T_{Spk}^{-1} = \begin{pmatrix} \dfrac{S(\omega)}{S(\omega)^2 - A(\omega)^2} & \dfrac{-A(\omega)}{S(\omega)^2 - A(\omega)^2} \\ \dfrac{-A(\omega)}{S(\omega)^2 - A(\omega)^2} & \dfrac{S(\omega)}{S(\omega)^2 - A(\omega)^2} \end{pmatrix}$$

Figure 3:
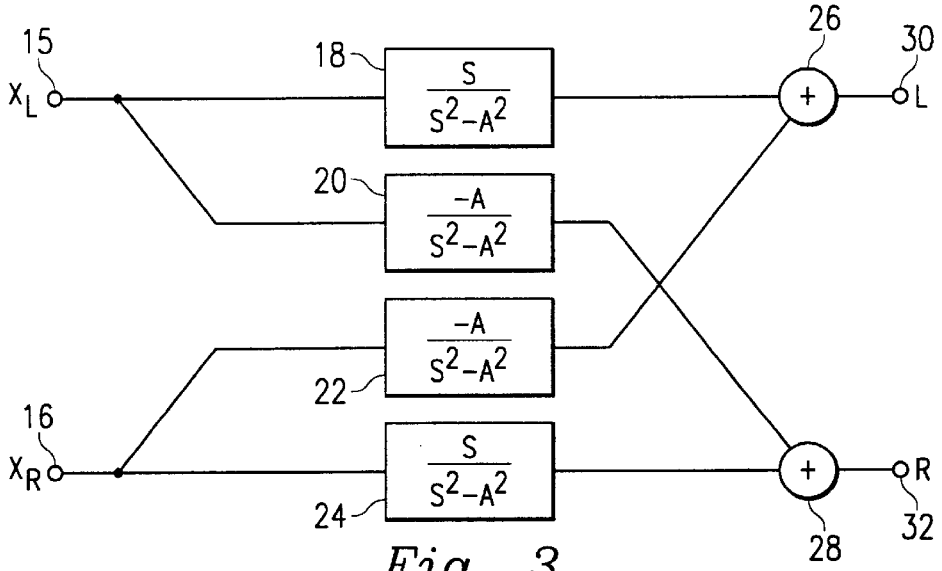
FIG. 3 is a block diagram of a crosstalk compensation filter according to Atal and Schroeder.

The coefficients in this matrix are expressed in the lattice filter shown in FIG. 3. The inputs $X_L$ and $X_R$ are filtered by the inverse speaker matrix $T_{Spk}^{-1}$ and then undergo the acoustical equivalent of the matrix $T_{Spk}$ so that in the ideal situation we obtain:

$$T_{Spk} * T_{Spk}^{-1} \begin{pmatrix} X_L \\ X_R \end{pmatrix} = \begin{pmatrix} X_L \\ X_R \end{pmatrix}$$

Thus, we have canceled the speakers' crosstalk, and the left and right ears receive the original signals $X_L$ and $X_R$ respectively. If these original signals were created by filtering a monaural signal with the HRTFs $A_x$ and $S_x$ respectively, then:

$$X_L(\omega)=A_x(\omega)Y(\omega)$$

$$X_R(\omega)=S_x(\omega)Y(\omega)$$

The listener would thus perceive the source of sound to emanate from the location X corresponding to the HRTFs $A_x$ and $S_x$.

The filtering required for a monaural signal to produce this spatial sound is:

$$\begin{pmatrix} \text{Left_channel} \\ \text{Right_channel} \end{pmatrix} = \begin{pmatrix} F(\omega) & G(\omega) \\ G(\omega) & F(\omega) \end{pmatrix} \begin{pmatrix} A_x(\omega)Y(\omega) \\ S_x(\omega)Y(\omega) \end{pmatrix}$$

where $F(\omega)=S(\omega)/(S(\omega)^2-A(\omega)^2)$ and $G(\omega)=-A(\omega)/(S(\omega)^2-A(\omega)^2)$.

However, we improve the filtering structure significantly over the Atal-Schroeder structure shown in FIG. 3 by diagonalizing the symmetric matrix $T_{spk}$ according to Cooper and Bauck [4–10] and Blumlein [14]. This results in:

$$\begin{pmatrix} S_x(\omega) & A_x(\omega) \\ A_x(\omega) & S_x(\omega) \end{pmatrix} = \begin{pmatrix} 1 & 1 \\ 1 & -1 \end{pmatrix} \begin{pmatrix} S_x(\omega) + A_x(\omega) & 0 \\ 0 & S_x(\omega) - A_x(\omega) \end{pmatrix} \begin{pmatrix} 1 & 1 \\ 1 & -1 \end{pmatrix}$$

and for $T_{spk}^{-1}$ we obtain:

$$(T_{Spk})^{-1} = \frac{1}{4}\begin{pmatrix} 1 & 1 \\ 1 & -1 \end{pmatrix} \begin{pmatrix} \dfrac{1}{S_x(\omega) + A_x(\omega)} & 0 \\ 0 & \dfrac{1}{S_x(\omega) - A_x(\omega)} \end{pmatrix} \begin{pmatrix} 1 & 1 \\ 1 & -1 \end{pmatrix}$$

We now define the following variables:

$$\Sigma_x(\omega)=0.5(A_x(\omega)+S_x(\omega)),\ \Delta_x(\omega)=0.5(A_x(\omega)-S_x(\omega))$$

$$\Sigma_{Spk}(\omega)=0.5(A_{Spk}(\omega)+S_{Spk}(\omega)),\ \Delta_{Spk}(\omega)=0.5(A_{Spk}(\omega)-S_{Spk}(\omega))$$

The monaural sound presented to the listener is then represented by the equation:

$$\begin{pmatrix} \text{Left} \\ \text{Right} \end{pmatrix} = \frac{1}{2}\begin{pmatrix} 1 & 1 \\ 1 & -1 \end{pmatrix} \begin{pmatrix} \frac{\sum_{\pm}(\omega)}{\sum_{Spk}(\omega)} & 0 \\ 0 & \frac{\Delta_{\pm}(\omega)}{\Delta_{Spk}(\omega)} \end{pmatrix} \begin{pmatrix} Y(\omega) \\ (-1)^m Y(\omega) \end{pmatrix}$$

Figure 4:
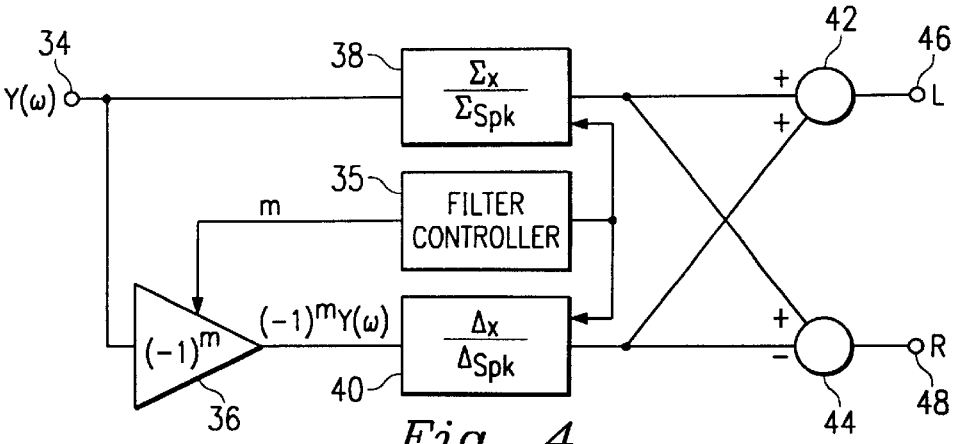
FIG. 4 is a block schematic of an improved positional filter for a monaural source, according to the invention.

The filter structure is thus simplified to that of FIG. 4. The index m is selected to be 1 when the virtual source is to the right of the listener and 2 when the virtual source is to his left.

In FIG. 4, the monaural input signal Y(ω) is applied to an input terminal 34. A filter controller 35 is provided for setting up the filter coefficients and other parameters in the apparatus. The signal from terminal 34 is provided to the input of a selective inverter 36 and to the input of a sigma filter 38. The output of the inverter 36 is connected to the input of a delta filter 40. A summing element 42 and a differencing element 44 are provided to add the outputs from sigma filter 38 and delta filter 40 to provide the left output signal L at a terminal 46, and to subtract the output of delta filter 40 from that of sigma filter 38 to provide the right output signal R at a terminal 48. The operation of the selective inverter 36 is controlled by the parameter m generated by the filter controller 35 as described previously.

The filter controller element 35 may, for instance, be a personal computer or may be part of the DSP in which the entire filter is implemented. Its purpose is either to compute or look up the appropriate filter coefficients or the poles and zeros of the transfer function which generates them, perform the necessary interpolation between HRTF poles and zeros in memory, set the value of parameter m to the correct value and to provide appropriate buffering to allow the coefficients to be changed dynamically.

There are a number of other advantages to using the sum and difference (Σ, Δ) approach in addition to the simplification of the filter structure. By using the Sigma and Delta filters, the phase difference between the right and left ear is automatically taken into account, since we add and subtract the original ipsolateral and contralateral HRTFs.

Research carried out since the 1960's ( see Blauert [2], Blauert [3], Shaw and Teranishi [12] and Wright et al. [13]) indicates that the auditory localizing system is organized into preferred bands of frequencies, which are dependent on the angle of incidence of the source of sound. Thus it is important when approximating the measured HRTF to pay particular attention to these spatial localizing intervals. These preferred bands can be shown to be characterized by notches and peaks caused by sound diffraction around the head and reflection caused by the torso and pinnae. This diffraction and local reflections from the folds of the pinnae cause peaks and notches to appear in the HRTF. Because the pinna's shape and its complex structure of folds varies for each individual, the HRTF is listener dependent, but nevertheless general spectral trends can be seen. Although there is variation among individuals' HRTFs, there exist certain spectral similarities that can be identified. It is known that these spectral trends enable different listeners to obtain spatial cues that utilizing other individuals' HRTFs. Thus the peaks and notches convey spectral cues which help resolve the spatial ambiguity associated with the cone of confusion. It is also known that as the angle of incident sound changes, the location of the notches and peaks changes to reflect the change in the direction of the incident sound. Butler [15] has termed this behavior the "migration of the notches".

To give an efficient implementation using the Sigma and Delta filters, we need to approximate the concatenated filters in a way that does not adversely affect the notches and peaks in the HRTF that provide spectral cues. The equalization method used by Cooper and Bauck [4–10] is to divide the Sigma and Delta filters by the absolute magnitude of the combined filters, that is: $\sqrt{|\Sigma(\omega)|^2+|\Delta(\omega)|^2}$. So the Sigma and Delta equalizations are:

$$\sum_{Eq}(\omega) = \frac{\sum(\omega)}{\sqrt{|\sum(\omega)|^2 + |\Delta(\omega)|^2}}$$

and $$\Delta_{Eq}(\omega) = \frac{\Delta(\omega)}{\sqrt{|\sum(\omega)|^2 + |\Delta(\omega)|^2}}$$

Figure 5A:
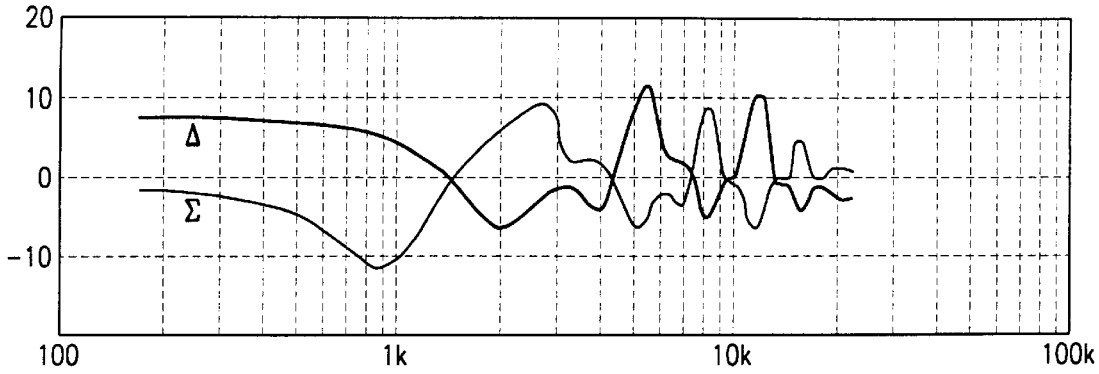
FIGS. 5*a* and 5*b* show the amplitude and phase (in the frequency domain) of the HRTF for the spherical head model for a source of sound at an angle of 60° or 120° in the horizontal plane, with loudspeakers assumed to be at +20° and −20°.
Figure 5B:
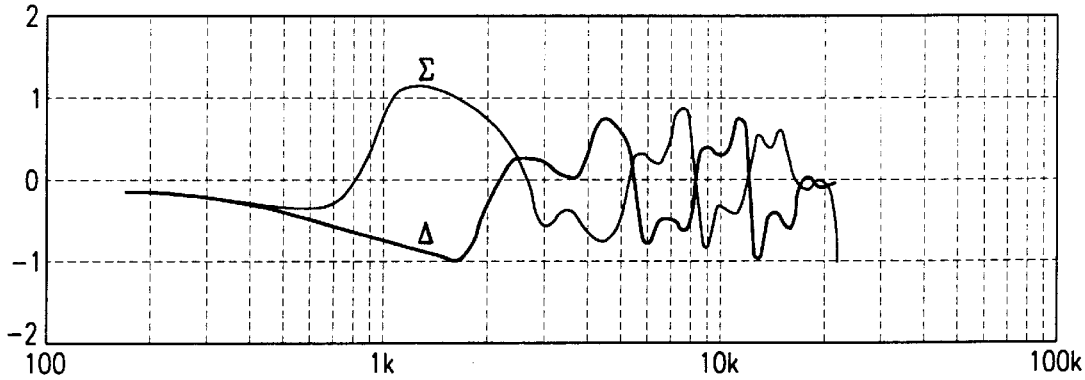

Thus it is quite clear that if both Sigma and Delta have peaks or notches then this equalization will flatten out these undulations. This has some very undesirable consequences. In particular, the spatial cues associated with the localizing bands will cause both Sigma and Delta to be reduced (or increased) in magnitude in certain frequency bands. Therefore this equalization will destroy some of the spatial information that helps to resolve some of the ambiguity associated with the cone of confusion. To show the deleterious consequence of this equalization we have calculated the Sigma and Delta filters for sound diffracting around a sphere model of the head. FIGS. 5*a* and 5*b* show the Sigma and Delta filters for the spherical head model for sound sources at 60 and 120 degrees. These filter functions are the same for both directions, since there are no pinnae in the spherical head model.

Figure 6A:
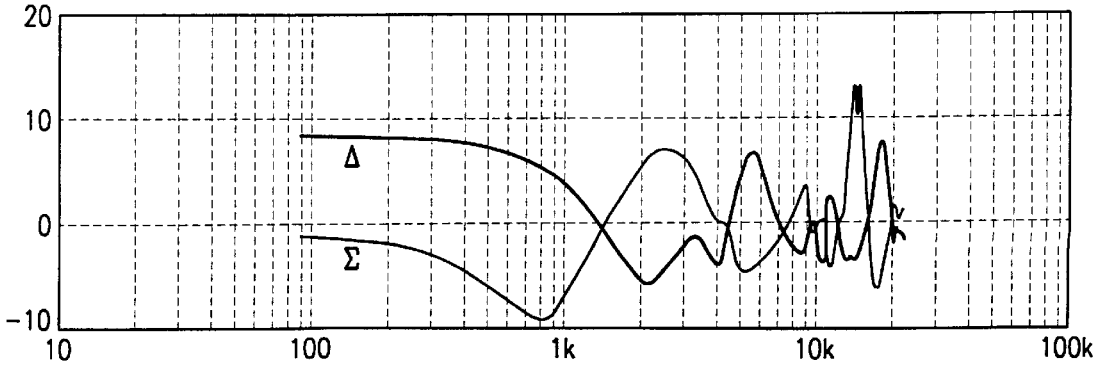
FIGS. 6*a* and 6*b* show the amplitude and phase of the HRTF equalized according to Cooper and Bauck, for a sound source at 60°, with speakers placed at ±20°.
Figure 6B:
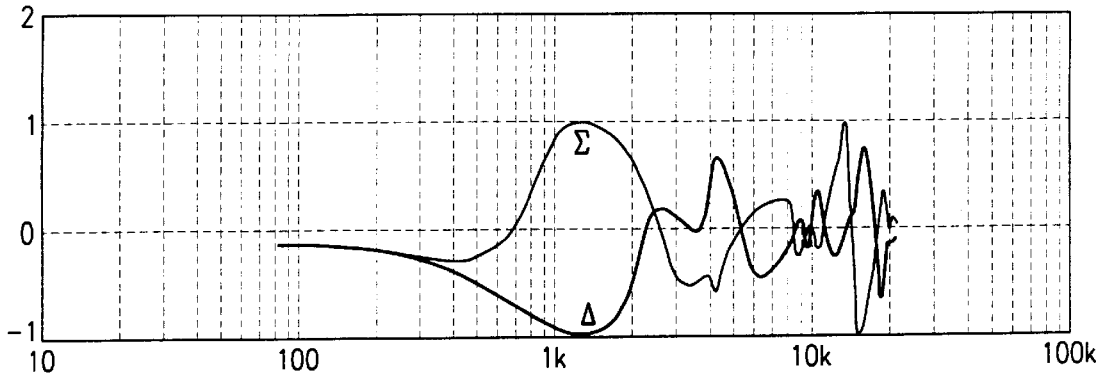
Figure 7A:
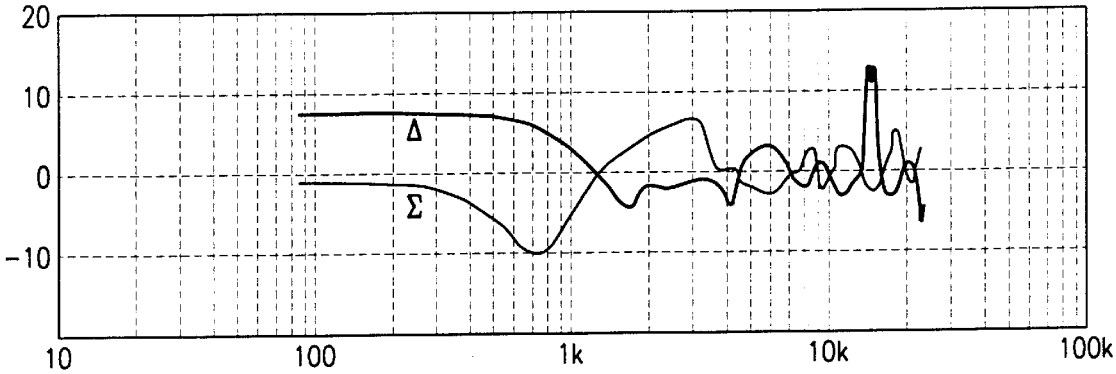
FIGS. 7*a* and 7*b* show the amplitude and phase of the HRTF equalized according to Cooper and Bauck, for a sound source at 120°, with speakers placed at ±20°.
Figure 7B:
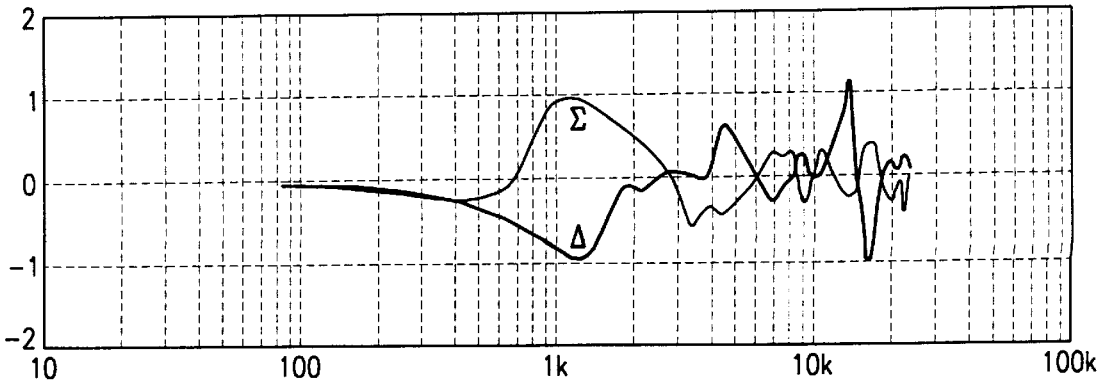
Figure 8A:
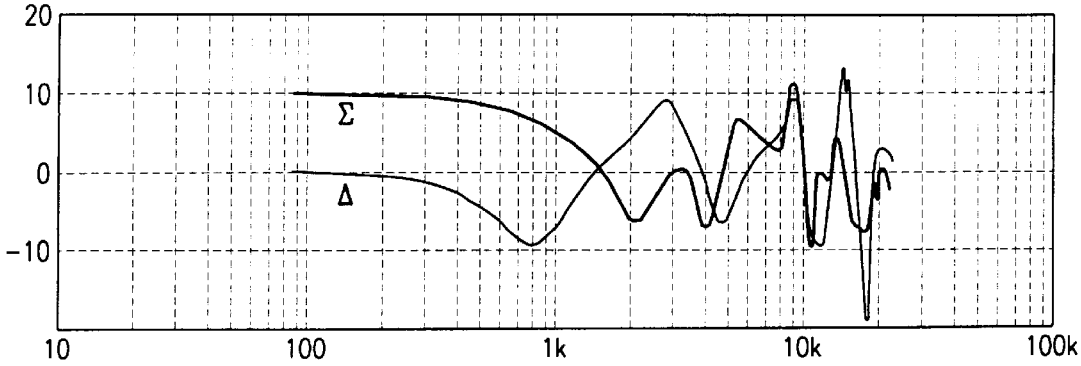
FIGS. 8*a* and 8*b* show the amplitude and phase of the HRTF not equalized according to Cooper and Bauck, for a sound source at 60°, with speakers placed at ±20°.
Figure 8B:
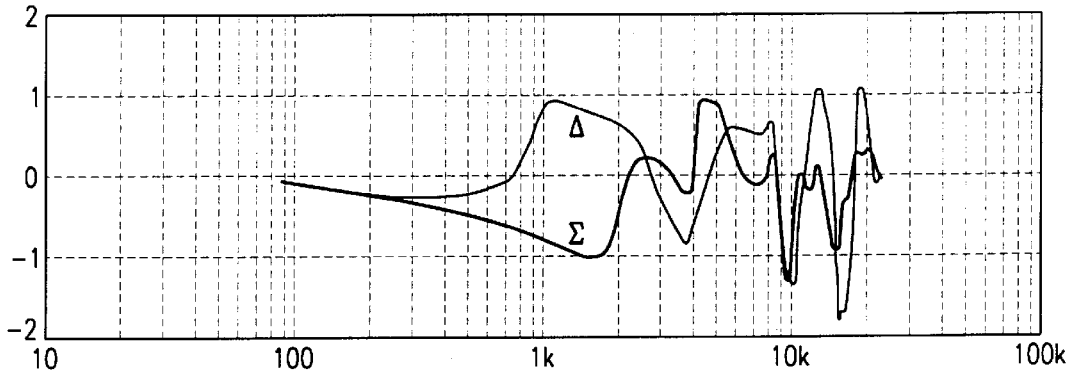
Figure 9A:
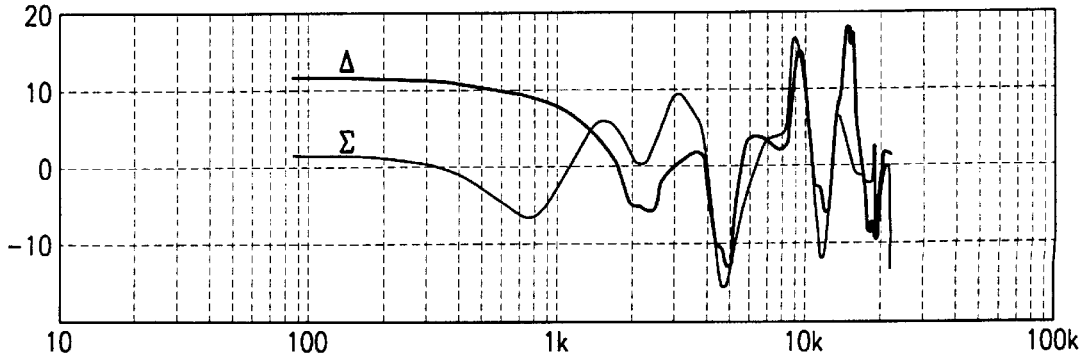
FIGS. 9*a* and 9*b* show the amplitude and phase of the HRTF not equalized according to Cooper and Bauck, for a sound source at 120°, with speakers placed at ±20°.
Figure 9B:
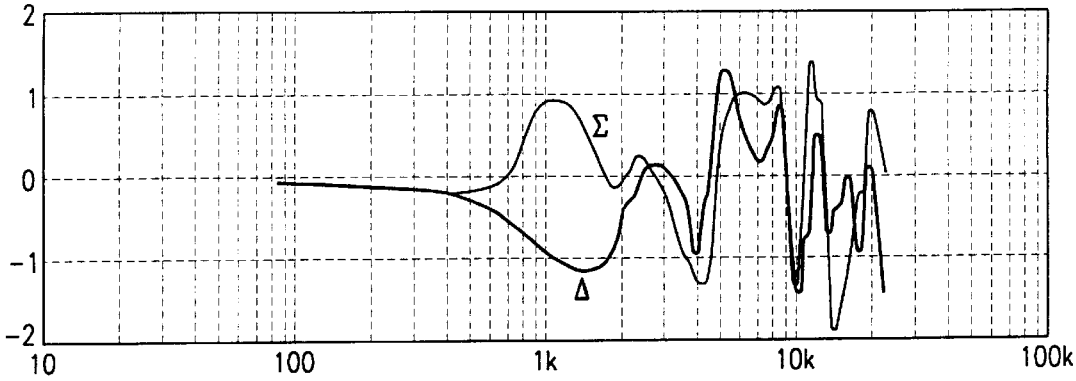

In FIGS. 6*a* and 6*b*, we show the Cooper-Bauck equalization for the Sigma and Delta filters for measured HRTFs for two source positions, 60 and 120 degrees. In both cases we have compensated for crosstalk cancellation for speakers at 20 and −20 degrees. As can be seen, there is very little difference between the two and it would be very difficult for a listener to distinguish between 60 and 120 degrees using Cooper-Bauck equalized filters. Effectively, the Cooper-Bauck equalization turns the head into a sphere. It equalizes the asymmetric behavior that the pinna introduces into the HRTF. But asymmetry helps to resolve the spatial ambiguity associated with the cone of confusion. Thus while the Cooper-Bauck equalization is very effective at providing localized cues for sound sources that lie on a horizontal circle in the range +90 and −90 degrees in front of the listener, it fails to capture the spectral cues essential to differentiate unambiguously between sounds behind and above the listener. Hence it is important when approximating the measured HRTF to pay particular attention to the spatial localizing frequency bands.

We would like to find a method that accurately approximates the HRTF in the neighborhood of these localizing bands using the least number of filter coefficients. To accomplish this we use critical band smoothing. Thus, much of the low to mid spectral behavior of the HRTF character is maintained below 10 kHz. Above 10 kHz, structure present in the concatenated HRTFs is increasingly smoothed at higher frequencies. Most of the features present at frequencies higher than 10 kHz can be approximated with the mean of the HRTFs in this frequency range.

Using the notation in FIG. 2, we determine the determine the transfer function from the speakers to the listener's ears to be:

$$\begin{pmatrix} L \\ R \end{pmatrix} = \begin{pmatrix} A & S \\ S & A \end{pmatrix} \begin{pmatrix} y_L \\ y_R \end{pmatrix} = T_{Spk}\, y,$$

where y is the input signal to the speakers. If we let $$y=[T_{Spk}]^{-}1_{T^{pos}}x$$

where $[T_{Spk}]^{-}1$ is an inverse of $T_{spk}$, so $[T_{Spk}]^{-1}T_{Spk}=1$. The inverse $(T_{Spk})^{-}1$ is $$(T_{Spk})^{-1} = \frac{1}{4}\begin{pmatrix} 1 & 1 \\ 1 & -1 \end{pmatrix}\begin{pmatrix} 1/\sum_{Spk}(\omega) & 0 \\ 0 & 1/\Delta_{Spk}(\omega) \end{pmatrix}\begin{pmatrix} 1 & 1 \\ 1 & -1 \end{pmatrix}$$

and $$T_{pos} = \begin{pmatrix} S_x(\omega) & A_x(\omega) \\ A(\omega) & S(\omega) \end{pmatrix} = \begin{pmatrix} 1 & 1 \\ 1 & -1 \end{pmatrix}\begin{pmatrix} \sum_x(\omega) & 0 \\ 0 & \Delta(\omega) \end{pmatrix}\begin{pmatrix} 1 & 1 \\ 1 & -1 \end{pmatrix}$$

Then the listener will perceive the sound as coming from the direction x if we feed the signal y to the speaker.

We therefore need to find an approximation to $[T_{Spk}]^{-}1T_{pos}$. One way to do this is to find a transfer function G that minimizes the error:

$$\epsilon^2=\|T_{pos}-T_{Spk}[G]\|,$$

since G will then approximate the transfer function $[T_{Spk}]^{-}1T_{pos}$ provided the error $\epsilon$ is small. As the matrices $T_{Spk}$ and $T_{pos}$ are symmetric, we can therefore express G as $$G(\omega) = \begin{pmatrix} 1 & 1 \\ 1 & -1 \end{pmatrix}\begin{pmatrix} G_\Sigma(\omega) & 0 \\ 0 & G_\Delta(\omega) \end{pmatrix}\begin{pmatrix} 1 & 1 \\ 1 & -1 \end{pmatrix}$$

Hence the expression for the error becomes $$\varepsilon^2 = \left\| \begin{pmatrix} 1 & 1 \\ 1 & -1 \end{pmatrix} \begin{pmatrix} \sum_x(\omega) - \sum_{Spk}(\omega)G_\Sigma(\omega) & 0 \\ 0 & \Delta_x(\omega) - \Delta_{Spk}(\omega)G_\Delta(\omega) \end{pmatrix}\begin{pmatrix} 1 & 1 \\ 1 & -1 \end{pmatrix} \right\|$$

Hence if we let $$\epsilon_\Sigma=(\Sigma_x(\omega)-\Sigma_{Spk}(\omega)G_\Sigma(\omega))$$

and $$\epsilon_\Delta=(\Delta_x(\omega)-\Delta_{Spk}(\omega)G_\Delta(\omega))$$

then by requiring that $\epsilon_\Delta$ and $\epsilon_\Sigma$ tend to zero we force $\epsilon\rightarrow 0$, and $$G_\Sigma\rightarrow[\Sigma_{Spk}]^{-}1\Sigma_{pos} \text{ and } G_\Delta\rightarrow[\Delta_{Spk}]^{-}1\Delta_{pos} \text{ as } \epsilon_\Sigma\rightarrow 0 \text{ and } \Sigma_\Delta\rightarrow 0,$$

respectively.

Because the auditory system is particularly sensitive to certain spectral bands, we weight the errors $\epsilon_\Delta^2$ and $\epsilon_\Sigma^2$ with a weighting function $W(\omega)$ that places more emphasis on the error in these spectral brands to give these frequency regions a preference. Thus, we have the error estimates:

$$\epsilon_\Sigma^2=\|\omega(\omega)(\Sigma_{pos}(\omega)-\Sigma_{Spk}(\omega)[G_\Sigma(\omega)])\|$$

and $$\epsilon_\Delta^2=\|\omega(\omega)(\Delta_{pos}(\omega)-\Delta_{Spk}(\omega)[G_\Delta(\omega)])\|$$

Thus the goal is to find approximations for the functions $[G_\Sigma(\omega)]$ and $[G_\Delta(\omega)]$ which minimize these errors. We can do this using X filtering (for FIR approximations, see [16]) or U filtering (for IIR approximations, see [17], [16]) algorithms used in adaptive filtering. Using this approach, we can even calculate approximations to these transfer functions in real time.

We briefly describe the approach for X filtering. Eriksson's U filtering method can also be implemented in a straightforward manner, though care has to be taken to guarantee stability and convergence. (In this case a lattice structure can be used to implement the adaptive IIR filtering to update the filter coefficients.) This adaptive filtering approach can also be implemented in the frequency domain.

We now briefly outline Widrow's X filtering adaptive filtering method. First, we measure or calculate numerically the transfer functions for S, A, $S_{Spk}$ and $A_{Spk}$. We then use these transfer functions to calculate $\Sigma_{spk}$, $\Delta_{spk}\Sigma_{pos}$, and $\Delta_{pos}$ for the speakers and desired virtual position respectively. Let x(n) be the input signal which is a broad band, e.g. white noise. We now assume that $$G_\Delta(n) = \sum_{k=o}^{K} g(k)x(n-k),$$

and from the measured data we have expressions for $$\Delta_{pos}(n) = \sum_{k=o}^{K} \delta_{pos}(k)x(n-k)$$

and $$\Delta_{Spk}(n) = \sum_{k=o}^{K} \delta_{Spk}(k)x(n-k)$$

We now define the new x filler $r_\Delta$ to be $$r_\Delta = \sum_{k=o}^{M} \delta_{Spk}(k)x(n-k),$$

so the delta error becomes $$g_\Delta(n) = \Delta_{pos}(n) - \sum_{k=o}^{K} g(k)r_\Delta(n-k).$$

To minimize the error $\epsilon_\Delta^2$ we use the method of steepest descent. That is, we adjust the taps g(k) so as to move in the direction that reduces the error. The LMS (least mean square) update is:

$$g_\Delta(l)=g_\Delta(l)-2\,\mu\epsilon_\Delta r_\Delta(m-l)\omega(l)$$

and $$g_\Sigma(l)=g_\Sigma(l)-2\,\mu\epsilon_\Sigma r_\Sigma(m-l)\omega(l)$$

Figure 11A:
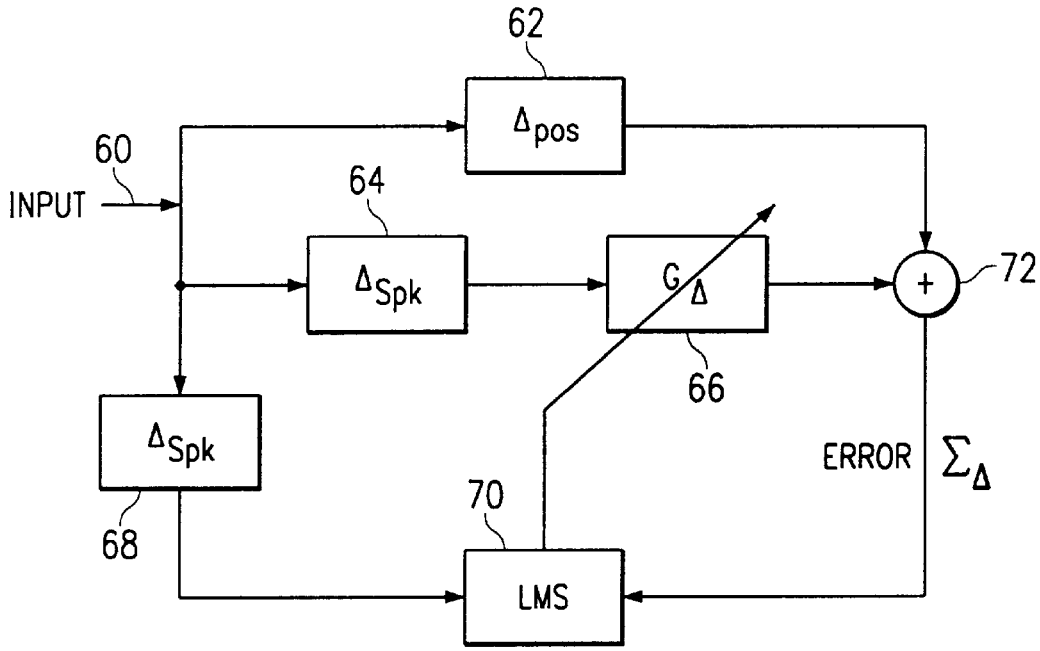
FIGS. 11*a* and 11*b* show in block schematic form an adaptive filter suitable for approximating the Sigma and Delta filtering algorithms in real time.
Figure 11B:
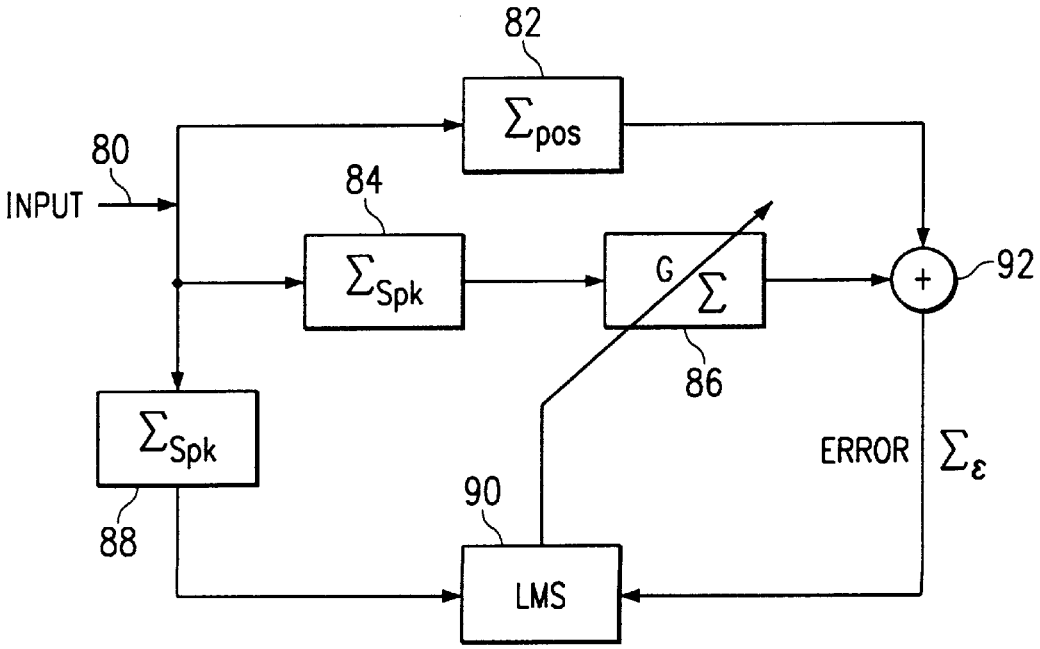

In FIGS. 11*a* and 11*b*, we show a block schematic of the above filtering scheme. FIG. 11*a* shows the Delta filter and FIG. 11*b* shows the Sigma filter, the basic form of these filters being identical. We describe the Delta filter below. The corresponding elements in FIG. 11*b* are numbered 20 higher than in FIG. 11*a*.

In FIG. 11*a*, the input signal, which is a broad band signal, is applied through signal path 60 to block 62 in the upper path, labeled $\Delta_{pos}$, the function of which is to filter the signal. This signal is also passed into functional block 64 in the middle path, labeled $\Delta_{spk}$, the function of which is to filter the signal. The output of this block 64 is passed into block 66 to update the adaptive weights $g_\Delta(k)$. The input signal at 60 is also passed to function block 68 which is identical to functional block 64 and is also labeled $\Delta_{spk}$. From this block 68 the signal is passed into the functional block 70 labeled LMS, the output of which controls the update of the adaptive weight in block 66.

The outputs of functional blocks 62 and 66 are added in adder 72, whose output is an error signal labeled Error. This signal is also fed to LMS functional block 70, where it is correlated with the signal from functional block 68. The resultant functional block 70 is therefore given by the equation for gΔ and the new weights $g_\Delta(l)$ are copied into block 66. Thus the adaptive weights $g_\Delta(l)$ are adjusted so as to reduce the error function $\epsilon_\Delta$.

In the approximation to G using an IIR filter (U filtering), we obtain a set of zeros and poles that approximate the concatenated filters. Because of the complexity of the filters and the fact that the position of the spectral peaks and notches change with position, i.e., the notches and peaks move to reflect the direction of sound, we need to model the "migration of the notches" in the spectrum of the HRTF. In the case of an IIR filter, we need to model the migration of the poles and zeros of the transfer function as a function of the incident angle. Also the peaks or notches may even disappear, depending on the direction of sound. Thus the notches and peaks and their migration must be approximated accurately by the concatenated filters. If we wish to interpolate between these filters for some intermediate position between the measured positions, we must first determine the poles and zeros at this desired location. To do this we first obtain the minimum number of poles and zeros needed to approximate accurately the smoothed concatenated filter at the measured positions. Thus having reduced the Sigma and Delta filters to the minimum number of poles and zeros for this angle, we proceed to do this for each of the locations from which we have measured HRTFs. We end up with sets of poles and zeros for each Sigma and Delta filter. We measure the HRTF for a set of points on a sphere surrounding the listener. We can then give a listener the impression that sound emanates from a specified direction by using the appropriate Sigma and Delta filters. If we desire to give the impression that sound emanates from a direction for which we did not measure an HRTF, we can interpolate between the measured poles and zeros that neighbor this position. But because the number of poles and zeros for the surrounding points may change, we may need to take account of the possibility that some of the notches and peaks vanish as the angle of incidence changes. We therefore need a method to accommodate this behavior.

One way to solve this problem is to add sets of pole-zero pairs to the Sigma and Delta filters that have the least number of poles and zeros, until each set of Sigma and Delta filters in this neighborhood has the same number. To avoid altering the Sigma and Delta filters, each added pole-zero pair should have the same coordinate values in the complex plane, so that it will not contribute to the filter.

We can however use these added pole zero pairs to interpolate. We do this by requiring a smooth curve which is parametrized by the azimuthal and polar angles to pass through the measured pole and the added pole. The localizations of the added poles are adjusted to make these interpolating curves smooth.

Figure 12:
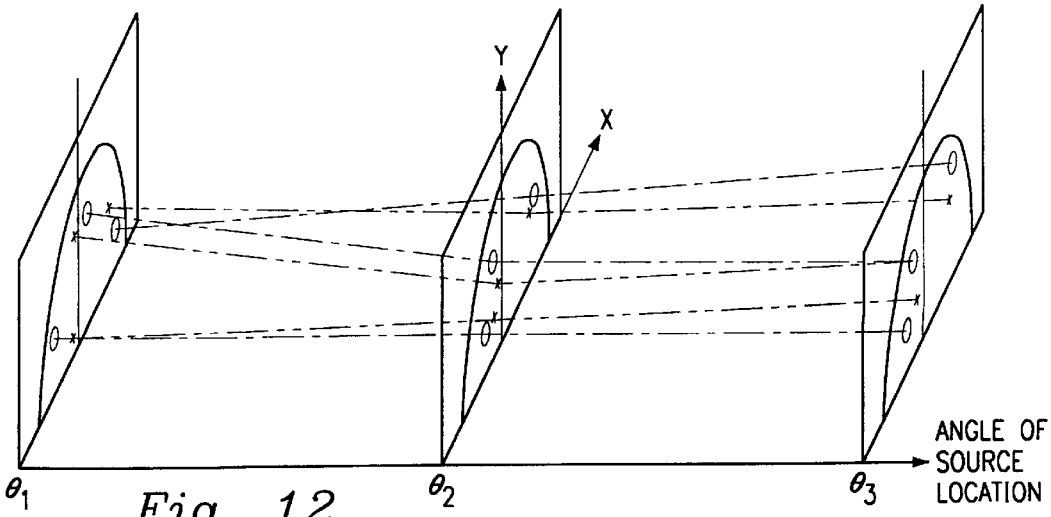
FIG. 12 shows the principle of interpolating between the poles and zeros of known HRTFs to obtain those for an unmeasured HRTF for an intermediate directional location, modeling the migration of notches and peaks in the HRTFs.

In FIG. 12 we show three sets of poles and zeros on their respective complex planes corresponding to different spatial Sigma filters. We add a pole-zero pair to the Sigma filter at position $\theta_3$. We now identify the notches and peaks that have migrated from their positions at $\theta_1$ to $\theta_2$. For the remaining pole-zero pair, which has disappeared at position $\theta_3$ we interpolate between the previous location of the poles and zeros at $\theta_1$ and $\theta_2$ and use this as a predictor of the position where the pole-zero pair vanishes. Doing this we obtain an expression for Sigma and Delta for a position not originally measured.

Figure 10:
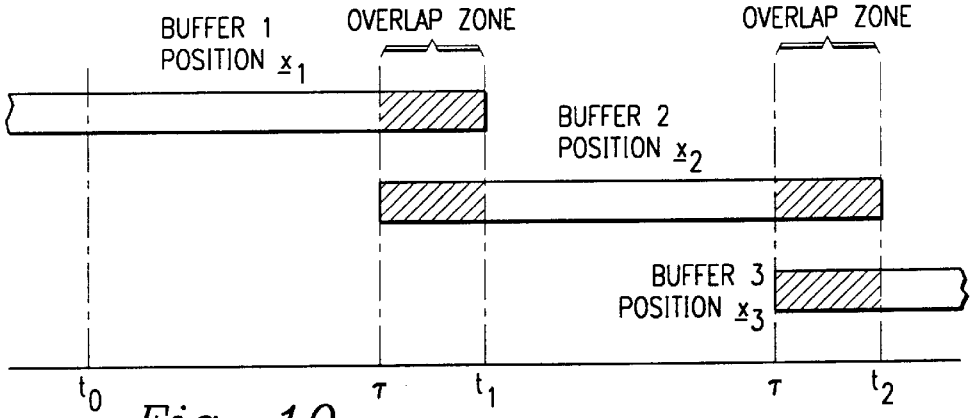
FIG. 10 illustrates the overlapping buffer schema used to reduce transient effects associated with switching to a new positional filter.

One possible implementation of this spatial localizing method is to use a buffering schema. Hence imagine we have a source of sound moving at some velocity. At time $t_0$ this source is at x(t=0). To indicate that the source is at this position, we start to filter the sound with the Sigma and Delta filters associated with this direction. We now choose a time interval, say τ, which is short enough that the listener will believe the sound seems to move in a continuous manner. After an interval the source of sound have changed its position and so will require new positional filters to be loaded. We now begin to filter the sound. To avoid introducing artifacts such as clicks (see FIG. 10) we start to filter the data with the new positional filter for a number of samples before we output the sample data. We do this to reduce transient effects associated with switching filters. To avoid gaps, we continue to filter with the old positional filters, and slowly fade into the new positional filtered data as the transients associated with the filter samples for the new positional filter are reduced to an acceptable level. The transient is determined by the proximity of the closest pole to the unit circle. We continue to do this until the sound has finished playing.

An additional cue for front-back discrimination is the presence of reflections and delays in the sound in an auditorium, or even of echoes in open spaces. We cam introduce reflections using the method of images to help resolve the back-front ambiguity.

Some applications of the present invention include sound synthesis, usually with a personal computer and sound card, permitting a wider variety of spatial effects and more accurate positioning of apparent sound sources relative to the listener, and providing greater flexibility to an application or game designer in terms of the types and the spatial locations of sounds that can be generated electronically.

While the preferred embodiments of the invention have been described herein, many other possible embodiments exist, and these and other modifications and variations will be apparent to those skilled in the art, without departing from the spirit of the invention.

What is claimed is:

1. Apparatus for steering the apparent direction relative to a listener of a monaural sound source signal reproducible on headphones using left and right audio filters wherein the filter coefficients are derived from the poles and zeros of acoustical head-related transfer functions (HRTFs) by summing and differencing said HRTFs for left and right ears to obtain sigma and delta transfer functions, said apparatus comprising:

an input terminal for receiving said monaural sound source signal;

sigma filter means for receiving said monaural sound source signal from said input terminal and filtering said monaural on source signal with said sigma transfer function;

inverting means for selectively inverting or not inverting the polarity of said monaural sound source signal received from said input terminal;

delta filter means for receiving said monaural sound source signal from said inverting those values which produce poles and zeros at the correct frequencies to generate said sigma means and filtering said monaural sound source signal with said delta transfer function;

means for presetting the coefficients of each of said sigma and delta filter means to and delta transfer functions appropriate for said apparent sound source direction and for selecting the polarity of the input to said delta filter means;

summing means for summing the output signals from sigma and delta filter means to produce a left output signal;

differencing means for subtracting the output signal of said delta filter means from that of said sigma filter means to produce a right output signal;

said apparatus being operative to produce from said monaural sound source signal a left and a right output signal suitable for application to headphones so that a listener hears the acoustical analog of said left and right output signals and perceives said left and right output signals to be acoustically equivalent to hearing said monaural sound source at said apparent direction;

wherein said signal and delta filter and said summing, differencing and inverting means are accomplished in digital signal processing ("DSP") means and said coefficients of said filter means are stored in memory associated with said DSP means;

wherein said coefficients of said filter means are stored in the form of pole and zero locations for a multiplicity of directions for which HRTFs have been measured, the apparatus further comprising:

means for generating additional coincident pole-zero pairs among the pole and zero locations for one of said multiplicity of directions such that the number of poles and zeros is equal to that for an adjacent one of said multiplicity of directions; and means for interpolating between the pole and zero locations for said one and said adjacent one of said multiplicity of directions to obtain approximate pole and zero locations for a direction intermediate between said adjacent directions;

said pole and zero locations for said intermediate direction providing sufficient information to approximate HRTFs for said intermediate direction and hence to compute appropriate coefficients for said sigma and delta filter means.

2. The apparatus of claim 1 further including a loudspeaker crosstalk cancellation filter means such that the said left and right output signals suitable for application to headphones are pre-compensated for application to left and right loudspeakers placed in front of a listener and making equal angles to the left and right of the front to back center line through said listener's head such that the listener hears in his left ear only the left output signal of the apparatus of claim 1 and in his right ear only the right output signal of the apparatus of claim 1 and perceives the resulting acoustical output as equivalent to hearing said monaural sound source at said apparent direction.

3. The apparatus of claim 2 wherein the loudspeaker crosstalk cancellation means is combined with said sigma and delta filter means to provide a more efficient circuit with fewer components.

4. The apparatus of claim 1 wherein said monaural sound source signal may be panned between a first direction and a second direction by causing the coefficients for said sigma and delta filter means for said first direction to be loaded into said DSP initially, and subsequently loading the coefficients for each successive intermediate direction between said first and second directions so that the monaural sound source signal appears to the listener to move in successive steps from said first direction to said second direction.

5. The apparatus of claim 4 wherein successive sets of said coefficients for said sigma and delta filter means are stored in separate buffers and wherein;

during a first interval of time, said monaural sound source signal is processed using the first set of coefficients;

during a second interval of time, said monaural sound source signal is processed using the next set of coefficients;

during a short overlap interval between said first and second intervals, said monaural sound source signal is processed using a combination of said first and next set of coefficients;

subsequently to said second interval of time, the process is repeated using a brief overlap interval between each change of the set of coefficients;

so as to minimize the transient effects that would be caused by instantaneously changing the set of filter coefficients.

* * * * *